US005479996A

United States Patent [19]

Jönsson et al.

[11] Patent Number: 5,479,996

[45] Date of Patent: Jan. 2, 1996

[54] ROCK DRILLING DEVICE WITH RECOIL DAMPER

[75] Inventors: Christer Jönsson; Jörgen Jonasson, both of Saltsjö-Boo, Sweden

[73] Assignee: Atlas Copco Rocktech AB, Nacka, Sweden

[21] Appl. No.: 319,419

[22] Filed: Oct. 6, 1994

[30] Foreign Application Priority Data

Oct. 15, 1993 [SE] Sweden ..... 9303398

[51] Int. Cl.[6] ..... B25D 17/24; E21B 6/00

[52] U.S. Cl. ..... 175/135; 173/2; 173/212; 175/296

[58] Field of Search ..... 175/135, 296; 173/2, 212

[56] References Cited

U.S. PATENT DOCUMENTS 4,073,350 2/1978 Eklöf et al. ..... 173/212
4,699,223 10/1987 Norén ..... 175/296 X
4,993,504 2/1991 Rodert et al. ..... 175/135

FOREIGN PATENT DOCUMENTS 2596681 10/1987 France ..... 173/212
3336540 4/1984 Germany ..... 173/212
283023 5/1990 Japan .

*Primary Examiner*—David J. Bagnell
*Attorney, Agent, or Firm*—Mark P. Stone

[57] ABSTRACT

Rock drilling device for drilling with a drill string comprising a set of tubes (1) and a set of rods (2) arranged centrally in the set of tubes. The rock drilling device comprises conduit (22) for sensing a liquid pressure in a recoil damper (21) and actuating valves (23,24) for stopping the supply of pressure liquid to a hammer device (25) of the rock drilling device when the pressure in the recoil damper (21) falls below a predetermined value in order to prevent that the drilling tool and/or the machine housing is damaged at a to low damper pressure

3 Claims, 3 Drawing Sheets

ROCK DRILLING DEVICE WITH RECOIL DAMPER

BACKGROUND OF THE INVENTION

The present invention relates to a rock drilling device for drilling in rock by means of a drill string comprising a set of tubes, and a set of rods arranged in the set of tubes and comprising a number of rods abutting loosely against each other.

When drilling with drill strings of the above mentioned kind it is essential that the rods forming the set of rods abut against each other when the hammer piston impacts the rearmost part of the set of rods so that the energy of the hammer piston is transferred to the drill bit at the other end of the drill string without unnecessary losses. This problem has been solved by means of the device according to U.S. Pat. No. 4,993,504. In the thus known device one still has problems when the drill bit penetrates into weaker formations. It has turned out that the set of rods in certain situations can sink down so that the projections, which are provided in order to prevent the rods from falling out from the set of tubes, come in contact with the tubes so that these are damaged by the impacts which the rods are exerted to by the hammer piston. It has also turned out that the pressure decrease which is obtained in the recoil damper can result in damages on the machine housing caused by the recoil from the set of rods.

SUMMARY OF THE INVENTION

The present invention, which is defined in the appended claims, aims at achieving a rock drilling device where the above mentioned problem with damages on the set of rods and/or machine housing is done away with.

BRIEF DESCRIPTION OF THE DRAWINGS

An embodiment of the invention is described below with reference to the accompanying drawings in which FIG. 1 schematically shows a section through a rock drilling device according to the invention.

DESCRIPTION OF THE BEST MODES FOR CARRYING OUT THE INVENTION

Figure 1:
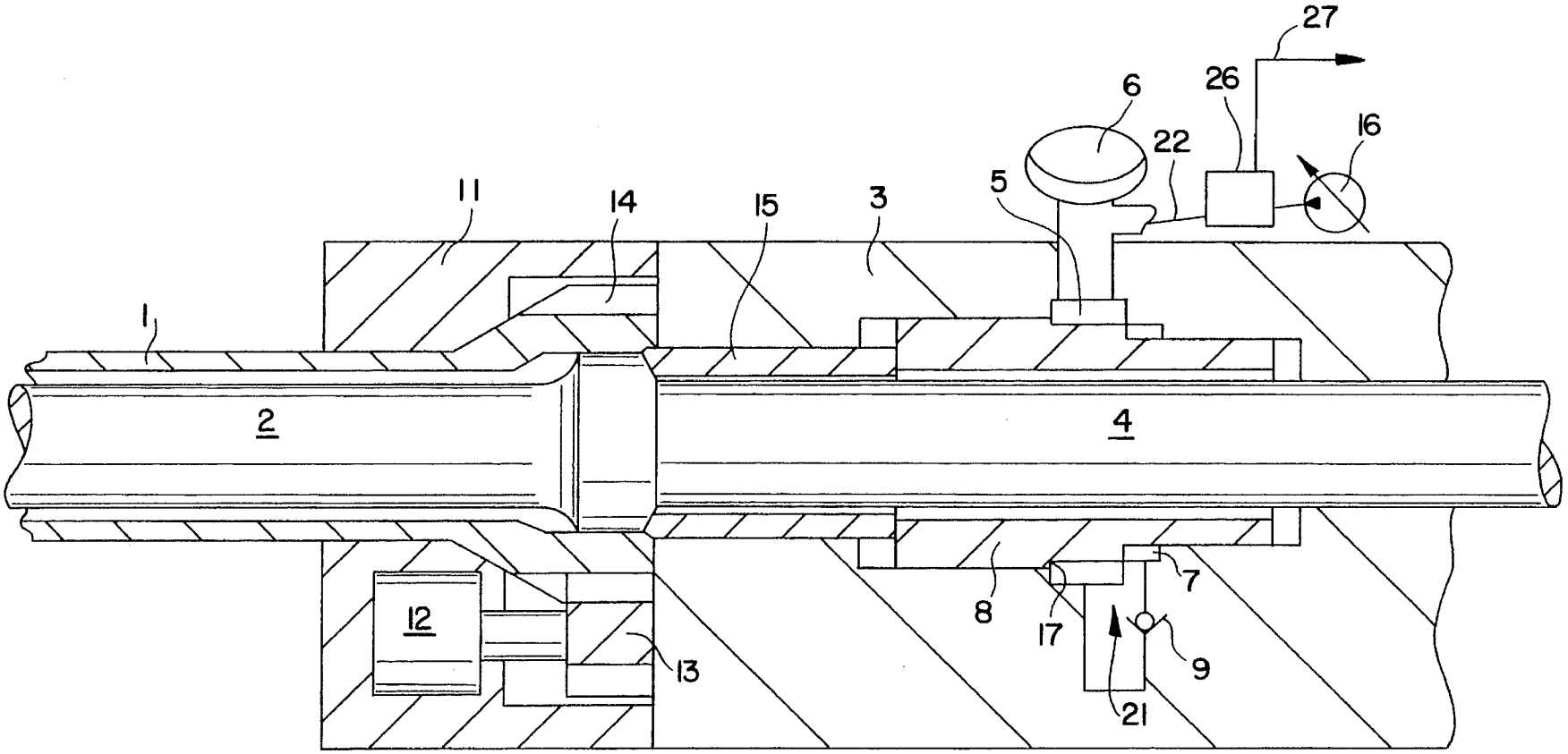

The rock drilling device shown in FIG. 1 comprises a machine housing 3 on which a front part 11 is mounted. The drilling device comprises a drill string comprising a set of tubes 1, which in FIG. 1 is represented by the drill sleeve 1 which is the rearmost part, and a set of rods 2, which in FIG. 1 is represented by an adapter 2 arranged in the machine. In the front end of the drill string is a not shown drill bit arranged. The drill bit is rotated by means of the set of tubes which is rotated by a rotation motor 12 via a gear wheel 13 which gears into teeth 14 on the drill sleeve 1. A hammer piston 4 is movable to-and-fro in the machine housing 3 in the usual way. The hammer piston transfers its energy to the adapter 2 in the set of rods. This energy is then transferred from rod to rod in the set of rods and from the set of rods to the drill bit. A sleeve 15 and a piston 8 are slidably arranged in the machine housing 3. These transfer a predetermined force, determined by the pressure in a first chamber 5, to the adapter 2. This pressure acts forwardly on a surface 17. This force is used during drilling to hold the rods of the set of rods together. The chamber 5 is connected with an accumulator 6 which is is supplied with pressure liquid from a pressure liquid source 16 via a control device 26 and a conduit 22. The piston 8 is with a narrow clearance movable into a second chamber 7. This means that the recoil from the rock is effectively damped because liquid is pressed out through the narrow slot between the piston 8 and the machine housing 3. In order to avoid cavitation when piston 8 moves out of chamber 7 a check valve 9 is arranged between the first and second chambers and is directed such that liquid flow is allowed from the first chamber 5 to the second chamber 7.

Figure 2:
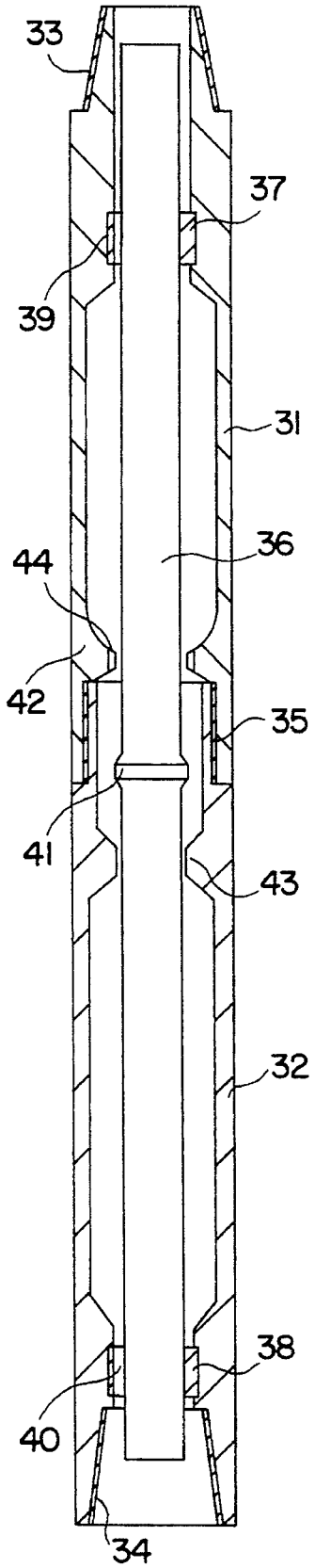
FIG. 2 shows a section through a drill string component which is used with the invention.

In FIG. 2 a drill string component included in the drill string is shown more in detail. The drill string component comprises two tubes 31, 32 connected by screw threads 35. The drill string component is at its ends provided with threads 33, 34 for connection to other drill string components, drill bit or the drilling machine. A rod 36 is glideably journalled in guides 37, 38 in the tubes 31, 32. The guides are provided with passages 39, 40 for passage of flushing medium. The rod 36 is provided with a flange 41 and the tubes 31, 32 with diameter reductions 42, 43. Through cooperation between these the rod 36 is prevented from falling out from the tubes 31, 32. The tube 31 is at the diameter reduction 42 provided with a groove 44 for passage of flushing medium. The shown drill string component is intended for upward drilling with liquid flushing. During extension of the drill string the rod 36 sinks down so that the flange 41 comes into abutment with a seat on the diameter reduction 43. Through this a check valve function is obtained which prevents flushing liquid from flowing out from the drill string.

Figure 3:
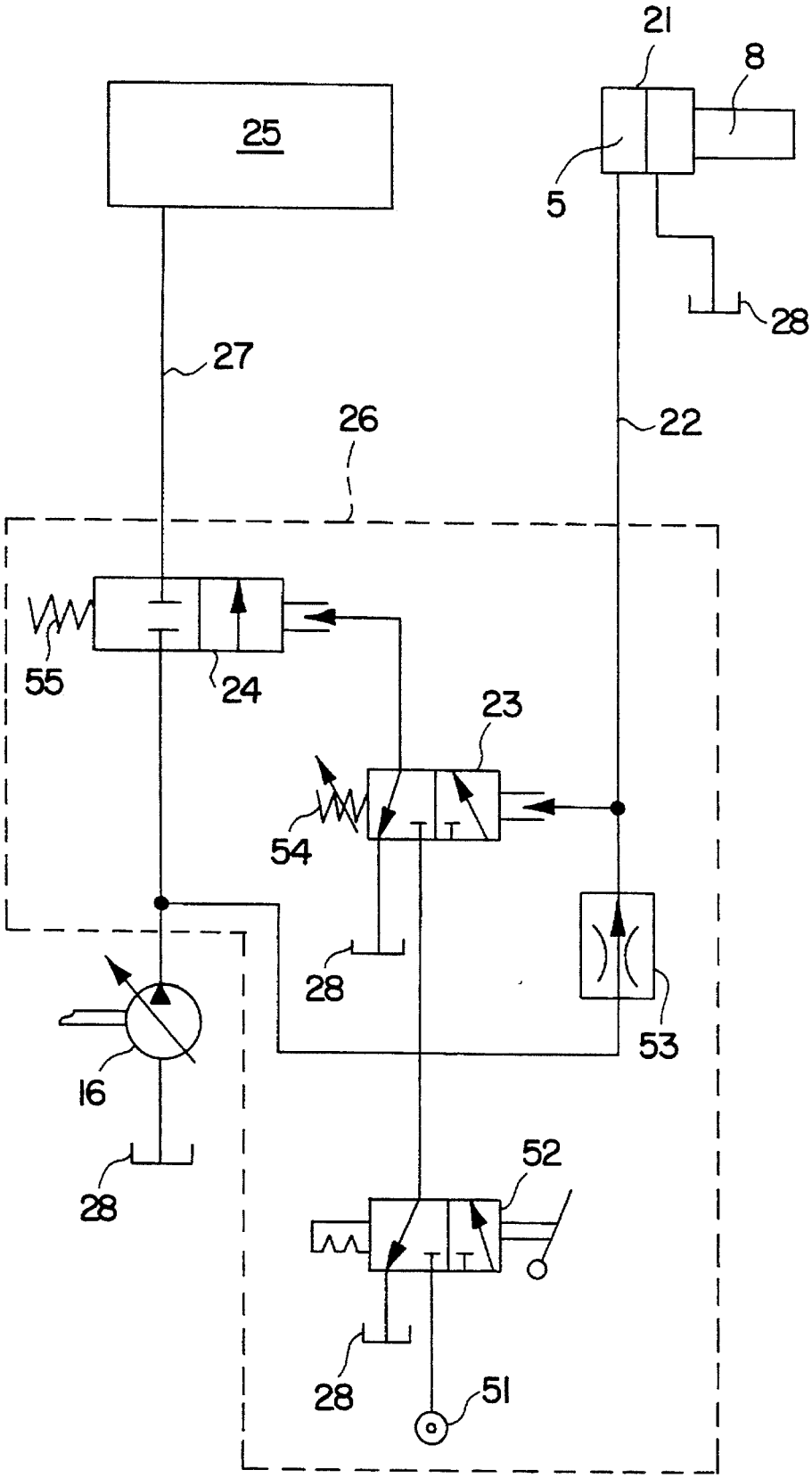
FIG. 3 shows a coupling diagram for the controlling of the hammer device according to the invention.

As shown in FIG. 3 the pump 16 sucks liquid from the tank 28 in order to provide, via the valve 24 and the conduit 27, the hammer device 25 with pressure liquid for the driving of the hammer piston 4 to-and-fro in the usual way. The pump 16 also provides the first chamber 5 of the recoil damper 21 with pressure liquid via the restriction 53 and the conduit 22. In order to start and stop the hammer device 25 the control device 26 is provided with a manual valve 52 which obtains pressure liquid from a pressure liquid source 51 which supplies a pressure which in a suitable way has been reduced in relation to the pressure from the pump 16. In order to start the hammer device 25 the pressure in the first chamber 5 of the recoil damper 21 must exceed a predetermined value which is adjusted by the spring 54. The pressure in the recoil damper is sensed via the conduit 22 which constitutes means for sensing the pressure. When the sensed pressure exceeds the predetermined value the valve body 23 is moved to the left in FIG. 3 against the action of the spring 54. If the valve body 52 in this position is moved to the left in FIG. 3 a connection is opened which provides the valve 24 with pressure liquid from the pressure source 51. Through this valve body 24 is moved to the left in FIG. 3 so that the hammer device is provided with pressure liquid for the driving of the hammer piston.

The shown rock drilling device functions in the following way to prevent the drilling tool and/or the machine housing from damage. If one during drilling encounters a region with lower drilling resistance the drilling rate increases momentarily resulting in a movement to the right in FIG. 3 of the piston 8. As a result the pressure in chamber 5 decreases. This pressure is sensed by the conduit 22. When this pressure falls below the predetermined pressure, adjusted by spring 54, the valve body 23 is moved to the right in FIG. 3 so that the connection between the valve 24 and the pressure source 51 is interrupted. Through this the valve body 24 is moved to the position shown in FIG. 3 by the spring 55. This results in the stopping of the hammer device 25 so that no impacts are delivered by the hammer piston 4.

We claim:

1. Rock drilling device comprising a machine housing (3), a hammer piston (4) movable to-and-fro in the machine housing, a drill string comprising a set of tubes (1) for transferring rotation to a drill bit and a set of rods (2) arranged centrally in the set of tubes for transferring impact energy from said hammer piston to said drill bit, and a recoil damper (21) arranged in the machine housing for damping recoils from said set of rods, characterized by means (22) for sensing a liquid pressure in said recoil damper (21) and actuating means (23,24) for stopping the supply of pressure liquid to a hammer device in the rock drilling device when the pressure in the recoil damper (21) falls below a predetermined value.

2. Rock drilling device as claimed in claim 1 wherein said means (22) for sensing includes a conduit coupled to a chamber (5) for sensing a decrease in fluid pressure within said chamber.

3. Rock drilling device as claimed in claim 1 wherein said actuating means (23) includes a valve body and means for exerting a resilient force on said valve body when the pressure sensed in said recoil damper (21) falls below said predetermined value.

* * * * *